US006764364B1

(12) United States Patent
Hickman et al.

(10) Patent No.: US 6,764,364 B1
(45) Date of Patent: Jul. 20, 2004

(54) SURF CRAFT SNAP-IN FIN SYSTEM

(76) Inventors: Scott Noble Hickman, 1501 Blackberry Ave., Arroyo Grande, CA (US) 93420; Michael Roy Hinman, P.O. Box 6101, Hilo, HI (US) 96720-8922

( * ) Notice: Subject to any disclaimer, the term of this patent is extended or adjusted under 35 U.S.C. 154(b) by 0 days.

(21) Appl. No.: 10/274,733

(22) Filed: Oct. 21, 2002

(51) Int. Cl.[7] ..... B63B 1/00; B63B 35/00
(52) U.S. Cl. ..... 441/79; 114/140
(58) Field of Search ..... 441/79; 114/140

(56) References Cited

U.S. PATENT DOCUMENTS

| | | | | |
|---|---|---|---|---|
| 3,422,471 | A | | 1/1969 | Morey et al. |
| 3,516,099 | A | | 6/1970 | Morey et al. |
| 3,564,632 | A | | 2/1971 | Bahne |
| 3,585,663 | A | | 6/1971 | Johnson |
| 3,659,300 | A | | 5/1972 | Johnson |
| 4,044,416 | A | | 8/1977 | Brewer et al. |
| 4,379,703 | A | | 4/1983 | Mizell |
| 4,421,492 | A | | 12/1983 | Leva |
| 4,804,347 | A | | 2/1989 | Ross |
| 5,328,397 | A | | 7/1994 | Whitty |
| 5,464,359 | A | | 11/1995 | Whitty |
| 5,649,846 | A | | 7/1997 | Harper et al. |
| 5,672,081 | A | | 9/1997 | Whitty |
| 5,830,025 | A | | 11/1998 | Fleming |
| 5,934,962 | A | * | 8/1999 | Daum et al. ..... 441/79 |
| 5,975,974 | A | | 11/1999 | McCausland |
| 5,997,376 | A | | 12/1999 | Block et al. |

OTHER PUBLICATIONS

O'Fish'L Snap In Fin Advertisement, Surfer Magazine, Apr., 2002, p. 70, vol. 43 No. 5, Primedia, Inc, Boulder, CO, USA.

* cited by examiner

*Primary Examiner*—Jesus D. Sotelo

(57) ABSTRACT

A system for attaching fins to surfboards and other surf craft utilizing plugs embedded into openings in the body of the board, these plugs having slotted openings which receive tapered tabs protruding from the bottom surface of the fin. The tabs are removably secured by engagement springs enabling the fins to be removed for transport or upon damage.

9 Claims, 10 Drawing Sheets

SURF CRAFT SNAP-IN FIN SYSTEM

CROSS REFERENCES TO RELATED APPLICATIONS

Not applicable.

FEDERALLY SPONSORED RESEARCH

Not applicable.

SEQUENCE LISTING OR PROGRAM

Not applicable.

BACKGROUND—FIELD OF INVENTION

This invention relates to surf craft fin systems, specifically to such fin systems that use fins that snap in and out of plugs set into the surfboard.

BACKGROUND—DISCUSSION OF PRIOR ART

In the manufacture of surfboards, a body of plastic foam material is shaped and then covered with a layer of fiber-reinforced resin, normally fiberglass. One or more fins, most commonly three, are fixed to the bottom of the board at the rear, normally by one of three methods. One method, the so-called "glassed-in" method attaches the fins to the board by means of fiber-reinforced resin. A second method uses a so-called "fin-box". A third method uses cylindrical plugs set into the board with resin. All three of these methods arc very popular. Each of these approaches has significant disadvantages.

Glassing the fins to the board (the "glassed-in" method) involves considerable labor costs and makes subsequent sanding and finishing of the board difficult. A further disadvantage of this fixing method is that the fiberglass fillet region at the base of the fin interferes with the hydrodynamics of the fins. This is believed to arise firstly from a reduction in the effective height of the fin, and from the outward flow of water caused by the fixing region, which in turn leads to turbulence and cavitation. There is an increased pressure drag cross sectional area. There is also a slightly increased skin drag length in the fillet of the fixing glass. As a result, the drive and bite afforded by the fins during turns is reduced and the performance and speed of the board is limited.

A further disadvantage of the attachment of fins by glassing on is that the fins must be present, fixed to the board, during all final finishing stages of the board's manufacture, increasing labor costs and restricting the quality of the final finish of the board.

In the use of the fin box method, a usually rectangular and sometimes cylindrical or oval cavity is formed in the board by the use of a router or hole saw and the fin box is inserted into this cavity. The most common fin box comprises a slot for the reception of the base of the fin, with a wider portion forming a lower slot at its base into which may be slid a pin, mounted horizontally through the front of the fin, to fix the front of the fin in the box. The rear of the fin is fixed by means of a vertical screw through a rearwardly extending portion of the base of the fin, this screw being driven into a drilled and tapped plate located in the rear end of the lower slot.

The use of fin boxes involves many disadvantages, including costly, labor-intensive fitting, an increase in the weight of the board, and looseness of the fin fixture, which causes reduced fin performance. Another disadvantage is that the joint between the box and the board cracks. Relative motion between the foam, the fiberglass skin, and the box material creates this crack. This cracking is worsened with increasing box size. This cracking results in leakage of water into the plastic foam material. The foam degrades when exposed to water if it is not repaired. These disadvantages of the fin box system, and others including the drag produced by the exposed slot at each end of the fin, are well known, and have lead to the general demise of this system.

The fin box does offer a theoretical advantage over the glassing-on of fins, and this is in the removability of the fins in the case of their need for replacement for repair, or during travel. The fin box design, however, makes removal and replacement difficult, and as a result this potential advantage is not realized.

Another variation of the fin box uses a horizontal pin in the rear of the box. This pin engages a horizontal cylindrical recess in the rear of the fin. The front of the fin is secured with a setscrew. The setscrew is threaded through a drilled hole in the plastic box. This setscrew is tightened against the front of the fin. There are further disadvantages of this method in addition to leakage and weight. The setscrew requires a special tool for insertion and removal of the fin. The setscrew is threaded into the plastic material of the fin box. These threads frequently strip requiring costly replacement of the entire box.

Another variation of the fin box includes a friction fit between the fin and the board with no other means of engagement. A further variation of this method includes a hook in the fin engaging the front of the fin into the front of the box. A replaceable snap in the rear of the box engages a protrusion on the back of the fin. With regards to the friction fit design there are several disadvantages. Besides the disadvantages of leakage and weight, another obvious disadvantage of the friction fit is that in the water this fit becomes lubricated. The lubricated friction fit fins can fall out. This is inconvenient and expensive. The snap-in method has a theoretical advantage in eliminating the requirement for a tool. This advantage is not realized because the replaceable snap, being in the box and not on the fin, requires costly repair and replacement of the box in the event of damage to any box feature used to retain the snap in the box. This snap-in method still suffers the disadvantages of added weight and leakage at the box edge.

Another variation of the fin box requires a hole routed completely through the surfboard. A screw is passed through the top of the board into the fin. Besides the other disadvantages of the fin box method mentioned above, this approach is difficult to manufacture. It weakens the surfboard in the thin tail area around the fins. This is especially severe near the center fin where the surfboard is usually thinnest. The through hole cuts away the entire "stringer" in this tail section. The stringer is a wooden "spine" running down the center of the entire length of the board. It adds strength and stiffness. This fin box design weakens the board in one of the most critical areas. This method also requires the engaging portion of the fin to be perpendicular to the surfboard lower surface. This prevents side fins from being set as custom camber angles. Most surfers prefer a certain favorite camber angle. This method sells fins with preset camber angles to try to overcome this disadvantage. This limits the options available to surfers using this fin system.

Another more recent variation of the fin box uses a rectangular plastic box set in a large cylinder of adhesive or resin. At least two tabs on the fins are inserted into slots in the cylindrical fin box. The tabs are secured by snaps in the plastic box. These snaps are a part of the box assembly and not in the fin. There are several disadvantages of this design. The large box adds weight to the board. A large cylindrical volume of the surfboard body is removed in order to set the box into the board. The large circular circumference leads to cracking and water leakage. This occurs where the fiberglass skin of the surfboard meets the edge of the box. The method of engaging the fins, being in the box, leads to inconvenient and costly repair of the box if damaged. This design was originally developed for very high-speed tow-in surfing on giant "macker" waves.

Another recent variation of the fin box uses a cam to laterally engage the fins. This is described in U.S. Pat. No. 5,975,974 to McCausland. During manufacture of the board a hole saw is used to cut three in-line overlapping cylindrical holes into the board. The box is shaped to fit this recess. It is shaped like three overlapping cylinders connected in-line at their sides. A cam mechanism in the box is rotated by hand. It applies a force to one side of a fin base protrusion or tabs. This method has a theoretical advantage. It eliminates a tool for fin insertion and removal. This advantage is not realized because the cam mechanism is in the box. If damaged it requires inconvenient, time consuming, and costly repair. This method still retains all the disadvantages of a fin box. It increases weight, leaks, and lacks fin stiffness. This method seeks to take advantage of the market leading plug method mentioned below. This cam box has been sized to allow the fins from the market leading plug based fin system to be fixed into the cam box.

In the use of plugs set into the board, cylindrical cavities are cut into the finished surfboard. These cavities extend through the fiberglass into the foam. They extend to a depth sufficient to allow the surface of the plug to be even with the surface of the surfboard. In addition, there may commonly be an annular cylindrical extension of the circumference of the cylinder. This is filled with resin or adhesive. This may extend through the foam to the deck, but not through the deck. The plugs are then set with resin into the board with a positioning jig as described in U.S. Pat. No. 5,328,397 (1994), U.S. Pat. No. 5,464,359 (1995), and U.S. Pat. No. 5,672,081 (1997), all to Whitty.

The plugs have rectangular slots formed into them during their manufacture. The fins have rectangular tabs formed into the base. These tabs fit into the plug slots. A setscrew is threaded through a hole in the plug. It is tightened laterally against the side of the fin tab.

This method has several disadvantages. During manufacture, resin must be prevented from running into the setscrew hole. If it unintentionally flows into this hole and sets, the threads for the setscrew are ruined. This makes the plug useless. The surfboard manufacturer must perform a time consuming replacement of the damaged plug.

Another disadvantage is that orientation of the plug is critical during manufacture. The setscrew hole can be covered with resin. As noted above, side fins are typically set at a slightly off perpendicular angle ("camber") to the bottom surface of the board. It is important to make sure that the setscrew is on the resulting high side of the plug or it will be covered with resin. Orientation of the plug is important during manufacture.

Another disadvantage is that the plugs crack. The outside circumference is small relative to the size of the slot. There is a very small amount of material between the corner of the slot and the outside circumference. During side loading the lever-action of the fin tabs puts stresses on the plugs. They split open from the hoop stresses. The crack occurs at the thin spot between the corner of the rectangular slot and the outside vertical surface of the plug. The fin becomes loose in the cracked plug. The board leaks near the crack. This flaw is terribly inconvenient and expensive to fix.

Another frequently encountered disadvantage is that the fin punches a hole through the board. It pokes through the fiberglass skin of the surfboard during removal.

The shape of the fin and the grip of a human hand tend to rotate the fin forward. There is a pointed front on the solid plastic fin. It punches a hole through the surfboard's fiberglass skin. It digs into the soft foam underneath. This requires ding repair to prevent water from entering the ding and degrading the foam.

Another disadvantage is that the fin is difficult to remove from the plug. It requires a special tool, a uniquely sized hex wrench. If lost, this special tool is inconvenient and expensive to replace. This disadvantage is exacerbated when traveling to exotic surf locations. High torque is required to tighten and loosen the setscrew. A more common tool, i.e., a slotted screwdriver, cannot be used. A grubscrew (slotted setscrew) is not a practical alternative to the hex recessed setscrew. The high torque causes the slotted screwdriver to become damaged.

Another disadvantage is that the torque required to loosen and tighten the setscrews is very high. The plastic threads in the plug become stripped with repeated use. The setscrew then no longer holds the fin in the plug and the plug must be replaced. Plug replacement is very costly and time consuming.

Due to the high torque of the setscrew, it is not obvious to the surfer when it has been loosened far enough to remove the fin. The fin can be removed with a slight engagement from the setscrew. The fin is then damaged in the location that is most critical to positive engagement. This leads to reduced fin stiffness and reduced surfboard maneuverability. In addition, this high torque makes it difficult to tell when the setscrew is fully inserted. This leads to over-tightening of the setscrew. This damages the threads in the plug.

Another disadvantage is that the fins are not secured stiffly into the plugs. The tabs are sized to be a "slip-fit" into the plug slots. This method does not use an interference fit as originally designed. An interference fit would prevent the surfer from installing the fins. Therefore, this slip fit leaves a slight gap between the plug slot and the fin tab. This gap is on the setscrew side of the plug slot. There is a pivot point when the setscrew is tightened. Forces on the fin pushing in the direction of the setscrew side allow the fin and tab to flex. The setscrew is a sort of pin support as with a cantilever beam. Flexing of the base of the fin is commonly known to reduce the performance of the fin. This method is less stiff than if the slot supported the fin tab. It does not support the tab along the entire depth of both sides.

Another disadvantage is that lateral engagement of the tab in the slot is required. Access to the setscrew or other engagement method limits location. It must be located to one side or the other of the fin body. It cannot be located in front or behind the fin tabs. The surfer would not be able to get a tool into the setscrew. The bottom surface of the fin covers the area available for front or rear access. The exposed hole for the setscrew adds turbulence to the hydrodynamic flow near the fin base.

OBJECTS AND ADVANTAGES

In our invention we use cylindrical plugs with slots with tapered sides. These receive tabs with tapered sides from the fin. The fins are snapped in place. They are secured to the plug by the tapered sides of the fin tabs and slots and a spring-loaded engaging system. There are no tools required to install or remove the fin.

There is no setscrew. During manufacture of the surfboard there is no setscrew hole to mask from resin. There are no threads to strip. There is no question about how much any screw must be tightened or loosened for removal or installation. There are no high torque issues due to a setscrew.

Our plugs are symmetrical so orientation during manufacture is not a requirement. During manufacture the camber angle may be set according to the surfer's preference. The plugs are lighter than fin boxes. They do not leak at the joint between the plug and the fiberglass skin. Less material is removed from the surfboard body during manufacture preserving the strength and integrity of the surfboard.

Our plugs have a larger diameter to allow more plug material between the plug wall and slot. This prevents cracking of the plug. The sides of the slot are tapered. The wall of the plug is thicker at the bottom of the taper. This is where the stresses are highest.

Our fins are designed with the front tab all the way at the front of the fin. This prevents the sharp front tip of the fin from poking a hole in the surfboard. The front of our fin pushes on the solid plastic of the plug while rotating forward. It does not push on the fiberglass over soft foam.

Our fins are snapped into our plugs and require no tool. There is no tool to lose or purchase.

Our fins and plugs are designed so that the fin tabs are fitted stiffly into the plugs. Their fit becomes tighter with increased engagement. The shape of the fin tabs and plug slot sides are both tapered. The tab is fully supported by the sides of the slot. The lead-in characteristic of the taper allows the fin tab to be easily inserted into the slot. Force from an interference fit is only experienced when the tab is fully inserted into the slot. This occurs over a short distance. The surfer can easily push the fin in over this short distance. This allows ease of installation. This maximizes the stiffness of the fins when installed in the plugs. There is no gap between the fin tab and plug recess. There is no setscrew to act as a pivot point or pin support.

Our tabs become wider at the point they join the fin. They become wider in both the front to back direction and in the side-to-side direction. This makes them strong and stiff.

Our invention has snaps on the fins. The plugs are solid structures with no moving parts. If for any reason a snap becomes damaged it can be easily and conveniently replaced. There is no reason for replacing the plug. Our snaps can be made removable from the fin making replacement easy.

Our invention does not require lateral engagement of the fin tabs in the plug slots. This allows engagement in the front and rear of the tabs. This allows both sides of the tabs to be fully supported by the slots. The tab sides are supported along the entire depth of the slot.

SUMMARY

A system for attaching fins to surfboards and other surf craft utilizing plugs embedded into openings in the body of the board, these plugs having slotted openings which receive tapered tabs protruding from the bottom surface of the fin. The tabs are removably secured by engagement springs enabling the fins to be removed for transport or upon damage.

DRAWINGS

Drawing Figures

Figure 4A:
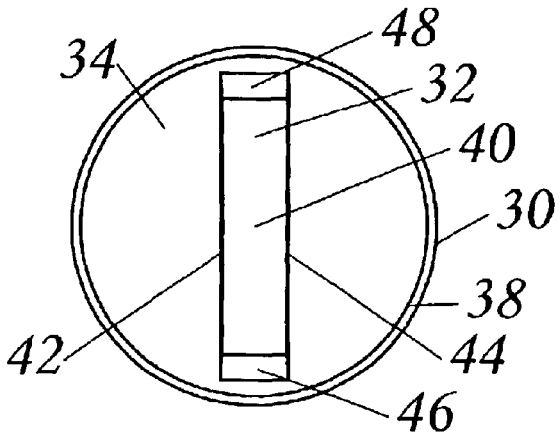
Figure 4B:
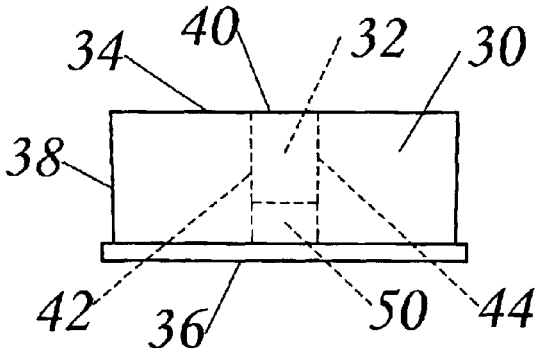
Figure 4C:
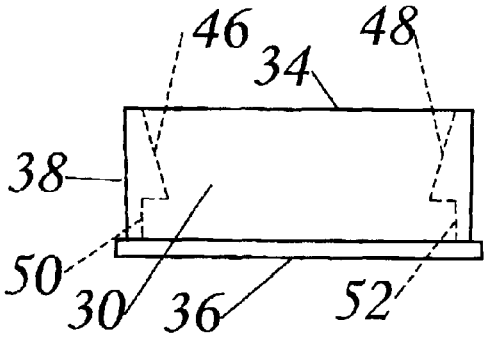

FIGS. 4*a*, 4*b*, and 4*c* are top, front, and side views, respectively, of a plug.

Figure 5A:
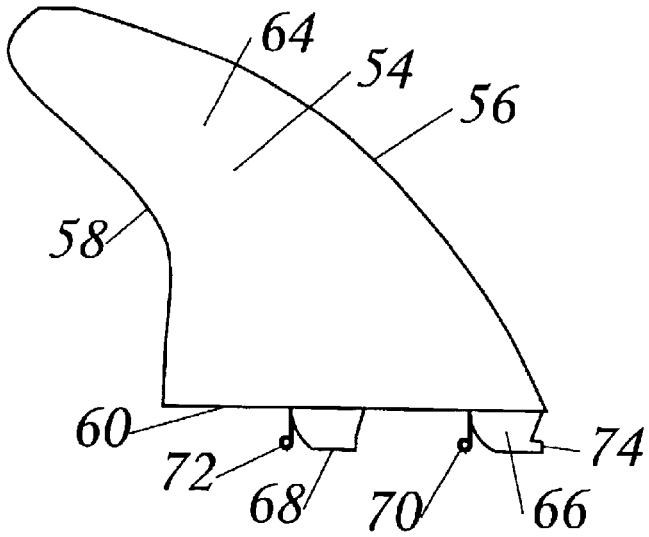
Figure 5C:
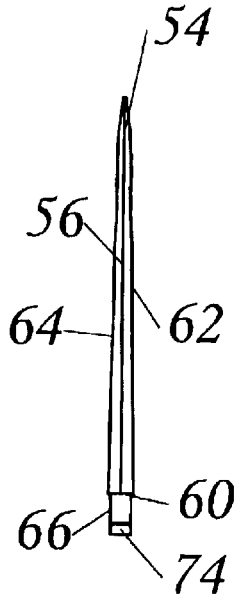
Figure 5B:
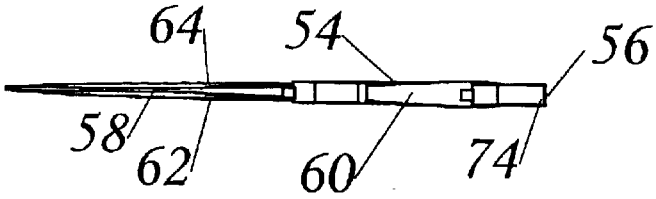

FIGS. 5*a*, 5*b*, and 5*c* are side, bottom, and front views, respectively, of a fin.

Figure 6:
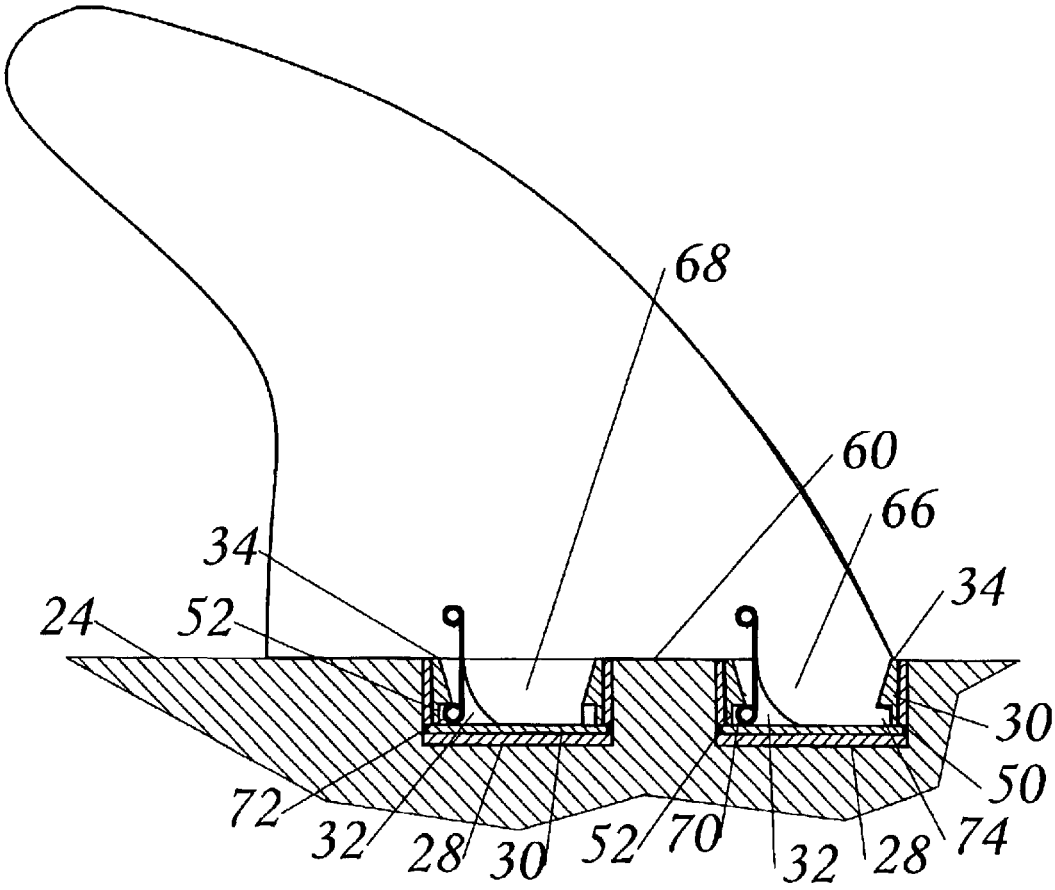

FIG. 6 is a side cross sectional view of one fin and two plugs in a surfboard.

Figure 7:
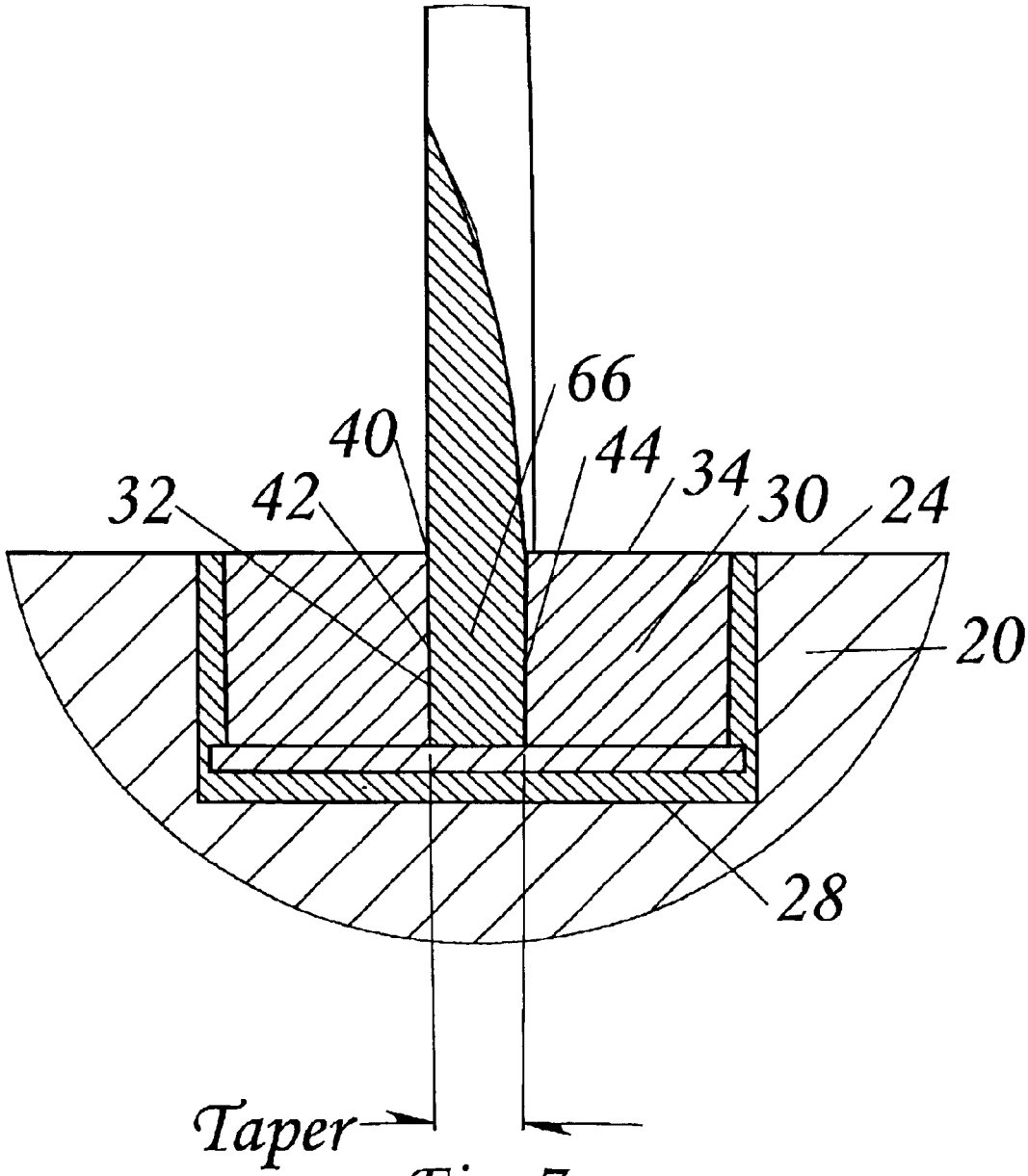

FIG. 7 is a front cross sectional view of one fin and two plugs in a surfboard.

Figure 8:
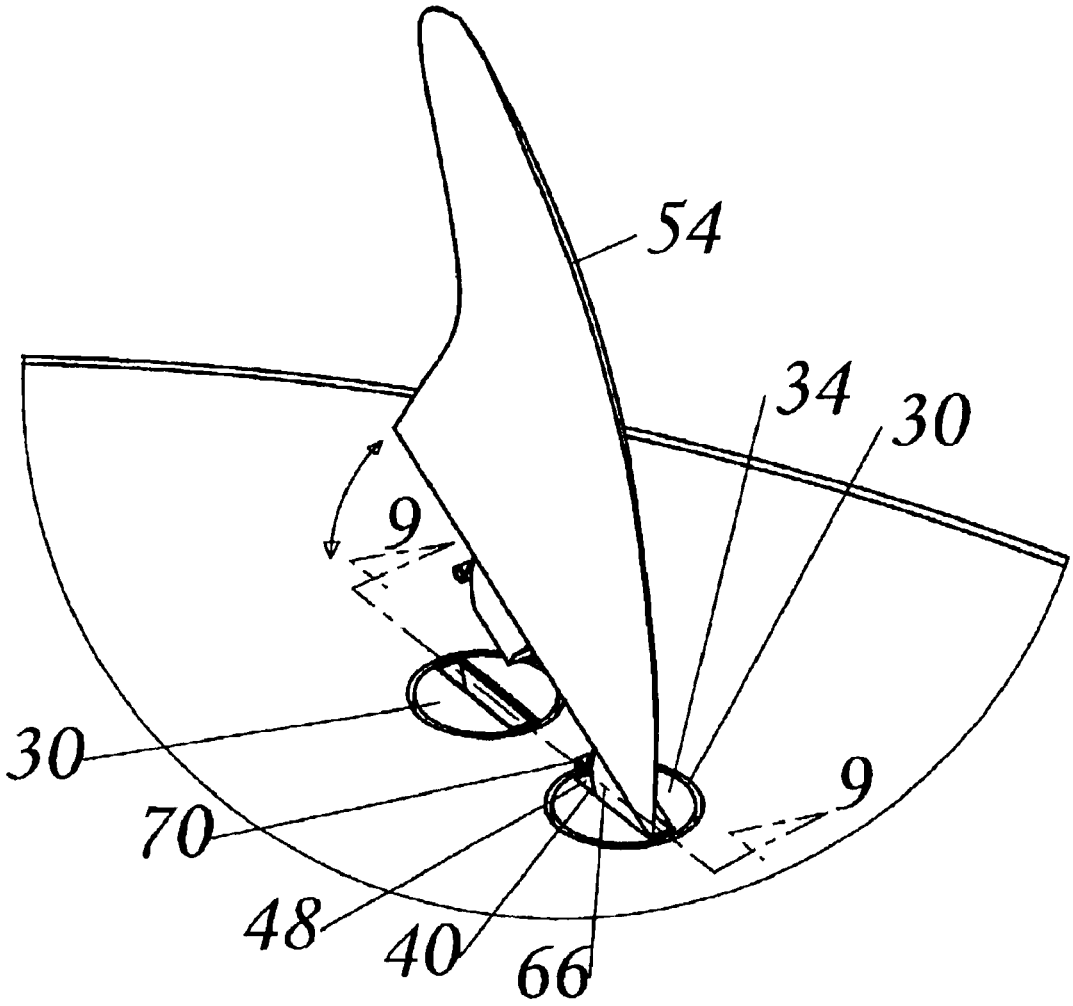

FIG. 8 is a three-dimensional view showing the fin being inserted or removed from the plugs.

Figure 9:
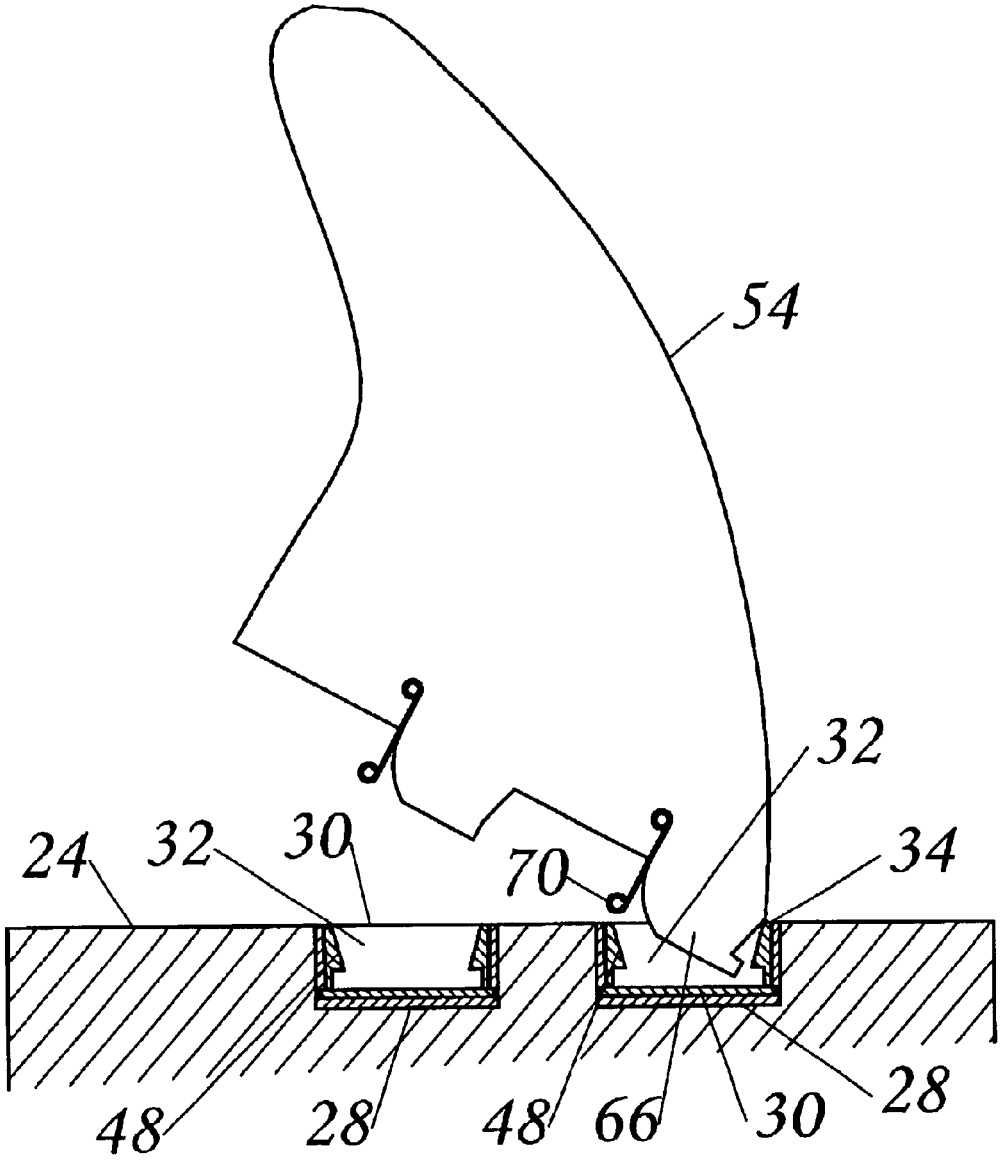

FIG. 9 is a side cross sectional view showing the fin being inserted or removed from the plugs.

Figure 10:
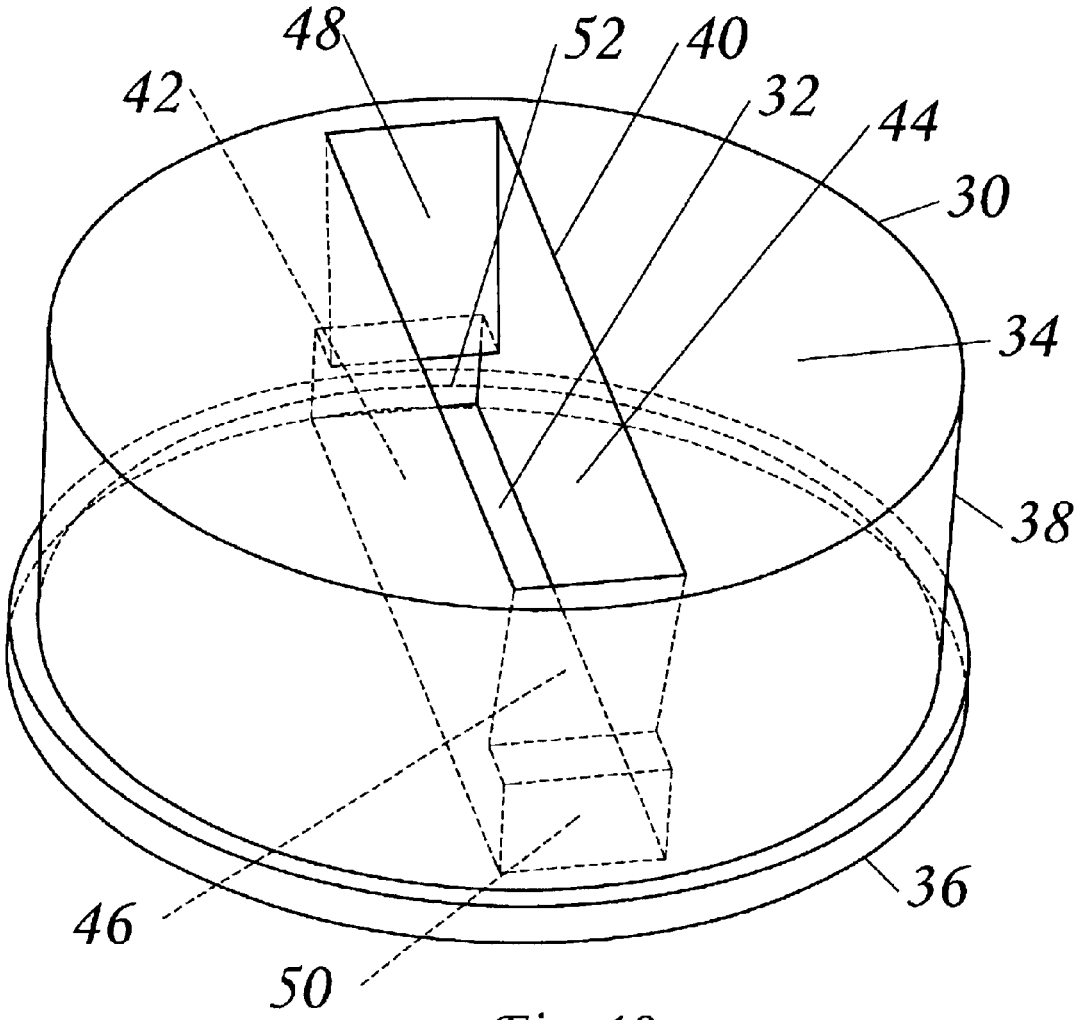

FIG. 10 is a three dimensional view of the plug.

REFERENCE NUMERALS IN DRAWINGS

20—surfboard body
22—surfboard upper surface
24—surfboard lower surface
26—surfboard continuous side surface
28—plug opening
30—fin plug
32—plug interior
34—plug top surface
36—plug bottom surface
38—plug side surface
40—slotted opening
42—left side wall
44—right side wall
46—front ramp
48—rear ramp
50—front undercut
52—rear undercut
54—fin
56—fin front edge
58—fin back edge
60—fin bottom surface
62—fin left side surface
64—fin front side surface
66—fin front protruding tab
68—fin rear protruding tab
70—fin front engagement spring
72—fin back engagement spring
74—fin hook

DETAILED DESCRIPTION

Description—FIGS. 2–8—Preferred Embodiment

A preferred embodiment of our fin system is illustrated in FIGS. 1 through 10.

Figure 1:
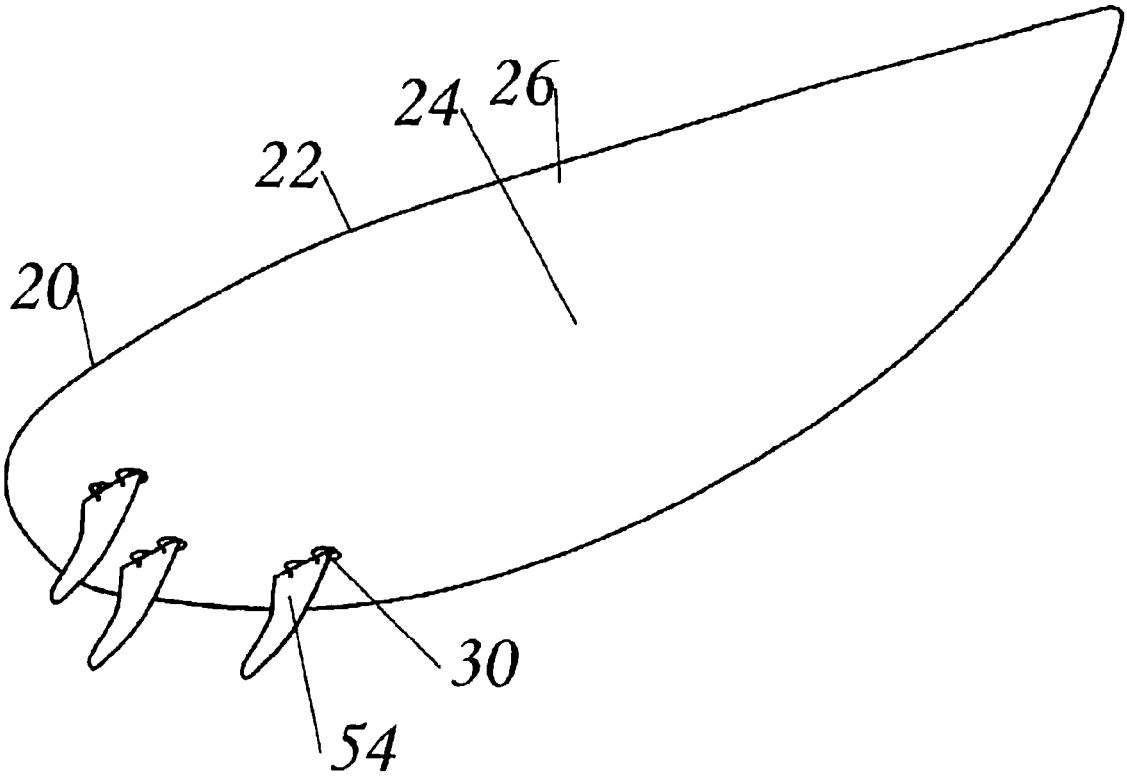
FIG. 1 is an overall view of a surfboard showing typical fin locations.

FIG. 1 shows an overall view of a surfboard incorporating our invention. The popular "thruster" or three-fin arrangement is shown. The surfboard has a body 20, a top surface 22, a lower surface 24, and a continuous side surface 26. Fins 54 are joined to the surfboard body with plugs 30. The fins are located on the lower surface of the surfboard towards the rear.

Figure 2:
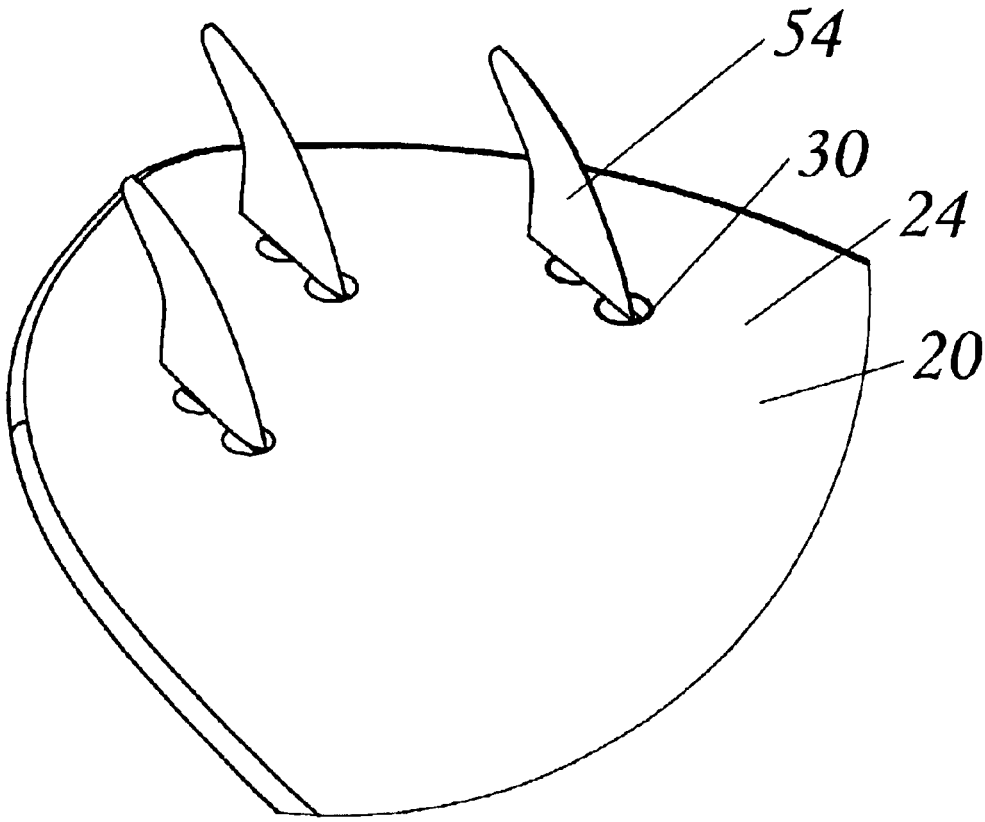
FIG. 2 is a three dimensional view of the bottom of a surfboard utilizing our invention in a three fin or "thruster" arrangement.

FIG. 2 shows a closer view of the fin system. The fins 54 are joined to the surfboard body 20 with plugs 30. The fins are located on the surfboard lower surface 24 towards the rear.

Figure 3:
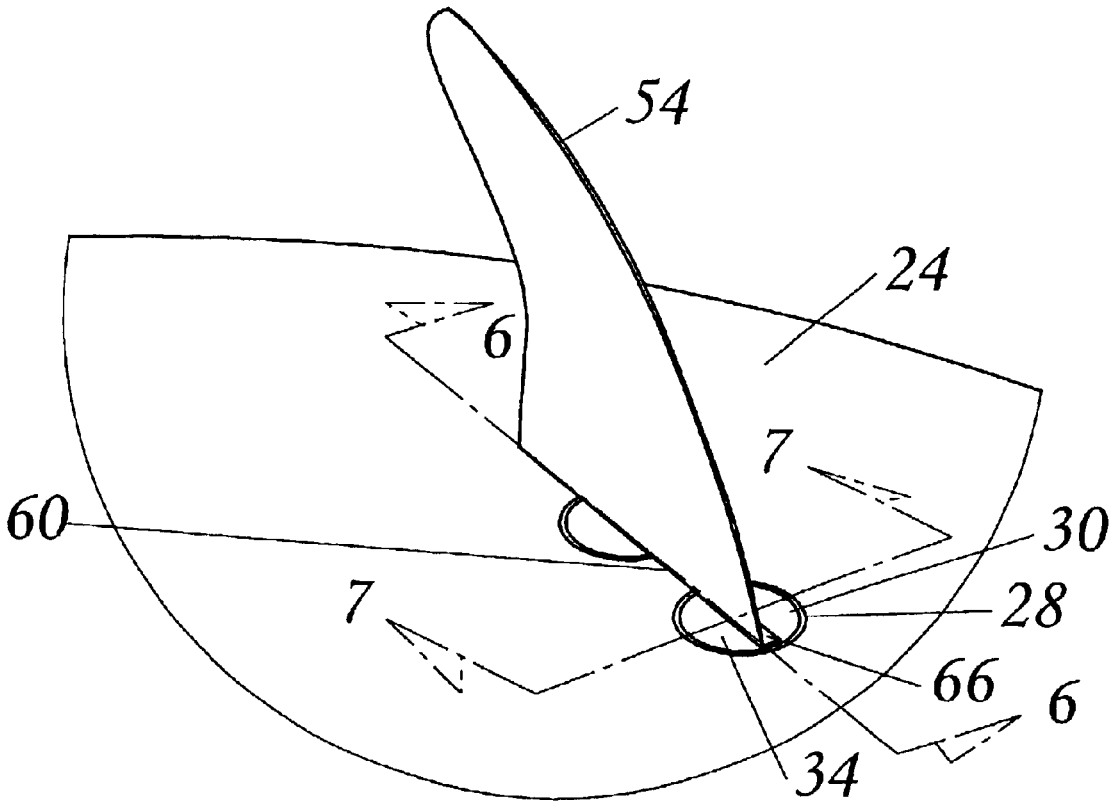
FIG. 3 is a three dimensional view of one fin and two plugs in a surfboard.

FIG. 3 shows a still closer view of the surfboard lower surface 24, the plugs 30, and the fin 54. The surfboard lower surface has openings 28. The plugs have a top surface 34. The plugs are shaped to fit into the openings so that the plug top surface is level with the surfboard lower surface. The level top surface of the plugs and the surfboard lower surface form a hydrodynamically smooth and uninterrupted surface. The plugs are bonded into the openings with a suitable adhesive. The fin has a bottom surface 60. The fin bottom surface is flush with the surfboard lower surface and plug top surfaces.

FIGS. 4*a*, 4*b*, and 4*c* are top, front, and side views, respectively, of the plug 30. The plug has the circular top surface 34, a circular bottom surface 36, a side surface 38, and an interior 32. The plug top surface has a slotted opening 40. The interior has a left side wall 42, a right side wall 44, a front ramp 46, a rear ramp 48, a front undercut 50, and a rear undercut 52. The plug is molded by conventional injection molding techniques using lifters to form the undercuts. It is made of polycarbonate or a similar engineering plastic. It can alternatively be machined in two pieces using a glued-on bottom cover to cover the undercuts.

FIGS. 5*a*, 5*b*, and 5*c* are side, bottom, and front views, respectively, of the fin 54. The fin has a front edge 56, a rear edge 58, the bottom surface 60, a left side surface 62, and a right side surface 64. The bottom surface has two protrusions, a front protruding tab 66, and a rear protruding tab 68. The front protruding tab has a forward protrusion, or hook 74. The fin has a front engagement spring 70 and a rear engagement spring 72. The springs have an engaging formation on their ends. The fin may be molded or machined. It may be manufactured from a variety of thermoset or thermoplastic materials including composite. A common material is polyester resin reinforced with fiberglass cloth. The springs can be made from any non-corroding material. They may be formed using conventional progressive stamping, a four-slide process, or hand forming. The springs are press fit into matching openings in the fin. They may alternatively be insert-molded into the fin. They may be made from metal, plastic, or as a protrusion from the fin bottom surface. Whether metal or plastic, they may be made replaceable in case of damage.

FIG. 6 is a cross sectional side view of a fin installed as shown in FIG. 3. Plugs 30 are fixed into the surfboard body plug openings 28 with resin or adhesive. The plug top surface 34 is level and even with the surfboard lower surface 24. The fin bottom surface 60 is even with the surfboard lower surface and the plug top surface. The front protruding tab 66 extends into the plug interior 32. The back protruding tab 68 extends into the plug interior 32. The fin front hook 74 is engaged in the front undercut 50. The front engagement spring 70 and back engagement spring 72 are engaged in the rear undercuts 52.

FIG. 7 is a front cross sectional view of a fin installed as shown in FIG. 3. It shows a front cross section of the surfboard body 20, the plug opening 28, the plug 30, and the fin front protruding tab 66. The plug is fitted into the plug opening in the orientation required for fin tab insertion and bonded to the surfboard body with adhesive. The plug top surface 34 is level and even with the surfboard lower surface 24. The front protruding tab extends through the plug slotted opening 40 and into the plug interior 32. The sides of the front protruding tab contact the plug slotted opening left side wall 42 and right side wall 44. Both the protruding tab and the plug slotted opening side walls are tapered. They are tapered such that the width is widest at the slotted plug opening. The protruding tab is completely supported on both sides by the plug side walls. As the tab is inserted into the slot the fit becomes tighter.

FIG. 8 is a three dimensional view of the fin 54 being inserted or removed from the plugs 30. The front protruding tab 66 of the fin is partially inserted into the plug slotted opening 40. The fin rotates on the front point during insertion and removal. The front point bears on the plug top surface 34 while rotating. The front engagement spring 70 slides on the rear ramp 48 of the front plug.

FIG. 9 is a side cross sectional view of the fin 54 being inserted or removed from the plugs as was shown in FIG. 8. Plugs 30 are fixed into the surfboard plug opening 28 with adhesive. The plug top surface 34 is level and even with the surfboard lower surface 24. The fin 54 rotates on the plug top surface 34. The front protruding tab 66 extends into the plug interior 32. The front engagement spring 70 is positioned to slide on the rear ramp 48.

FIG. 10 is a three dimensional view of the plug 30. The plug is symmetrical side to side and front to back. The plug bottom surface 36 is circular. The plug interior 32 is accessed through the slotted opening 40 in the circular plug top surface 34. The plug interior is composed of the left side wall 42, the right side wall 44, the front ramp 46, the rear ramp 48, the front undercut 50, and the rear undercut 52. The plug side surface 38 is between the plug's top and bottom surfaces.

Operation of Preferred Embodiment—FIGS. 3, 6–9

During insertion the fin 54 is tilted. The front protruding tab 66 is inserted into the plug slotted opening 40. The fin hook 74 on the front protruding tab goes into the front plug's front undercut 50. The fin is then rotated back and pressed down. This causes the rear protruding tab 68 to go into the slotted opening 40 of the rear plug. The fin is rotated further back while simultaneously pressing down. The front engagement spring 70 slides on the front plug's rear ramp 48. The back engagement 72 spring slides on the back plug's rear ramp 48. Sufficient downward force is applied to the fin 54 to overcome the spring force of the engagement springs and the slight interference fit of the protruding tabs against the plug left side wall 42 and right side wall 44. The fin snaps-in by pressing down until both engagement springs engage the rear undercuts 52 of each plug. The fin bottom surface 60 is held in contact with the surfboard lower surface 24 by the spring force of the engagement springs and tapered interference fit of the fin protruding tabs and plug side walls. The fin is thus removably joined to the surfboard body.

To remove, a slight forward shock is applied to the fin. The surfer's hand wrapped in a cloth is sufficient to apply this shock. This disengages the back engagement spring from the rear undercut of the rear plug. This shock also removes the force due to the tapered interference fit. The front engagement spring is still partially engaged with the rear undercut of the front plug. This prevents the fin from completely falling out if hit from behind while surfing. The fin is rotated forward. This disengages the front engagement spring completely from the rear undercut of the front plug. It also disengages the front hook from front plug's front undercut. At this point both engagement springs and the front hook have been disengaged. The fin can be pulled straight up and out of the slotted opening of the front plug.

Alternate Embodiments

While our above description contains many specificities, these should not be construed as limitations on the scope of our invention, but rather as an exemplification of one preferred embodiment thereof. Many other variations are possible. For example, the spring can be made removable from the fins or plugs, making them replaceable in case of damage or for upgrade. The shape of the springs, ramps, snaps, and undercuts may be varied for different feels and snap characteristics. The tabs may be made removable from the fins. The sides of the tabs and slots may provide stiffness by other variations in substantially non-parallel shapes other than a tapered shape. For example, the taper may only extend halfway up the tabs, or the tabs and slots may be slightly rounded to give a tapered-like effect that becomes stiffer and tighter when fully inserted. The shapes of the tab and slot may be slightly different allowing an "over-center" feel as the fin is installed. More than two tabs and plugs may be used. The overall shapes of the tabs and slots are not limited to a rectangle. They could be oval, streamlined, or irregular. They could include alignment ribs, slots, or serrations. They could include ribs to protect the spring or control its deflection. They could be any shape where the length is substantially greater than the width. The hook on the front of the front protruding tab can alternatively be an engagement spring. The shapes of the various pieces may vary without changing the fundamental function of our invention.

Accordingly, the scope of the invention should be determined not by the embodiments illustrated, but by the appended claims and their equivalents.

What is claimed is:

1. A surf craft fin system comprising:

(a) a surf craft body with an upper, a lower, and a continuous side surface, (b) a plurality of openings in the body lower surface, (c) a plurality of fin plugs with an interior, a circular top surface, a circular bottom surface, and a side surface, the bottom and side surfaces arranged such that the plug is bonded to a body opening, (d) a slotted opening in the fin plug interior with a left side wall and a right side wall, at least one ramp and at least one undercut, the side walls tapered so that they are further apart where they meet the top surface, and (e) a fin with a front edge, a back edge, a bottom surface, a left side surface, and a right side surface, a plurality of protruding tabs on the bottom surface, and at least one engagement spring arranged to fit into the fin plug slotted opening such that tab full insertion into the fin plug slotted opening removably joins the fin to the body, whereby the fins can be removed and installed without the use of a tool.

2. The surf craft fin system of claim 1 wherein the fin has a front protruding tab and a rear protruding tab.

3. The surf craft fin system of claim 2 wherein the front protruding tab has a forward protruding hook.

4. The surf craft fin system of claim 3 wherein the fin has a front engagement spring and a rear engagement spring.

5. The surf craft fin system of claim 1 wherein the fin plug slotted opening is rectangular.

6. The surf craft fin system of claim 1 wherein the fin plug is arranged such that the top surface is level with the surfboard body lower surface.

7. The surf craft fin system of claim 1 wherein the fin plug is symmetrical front to back and side to side.

8. The surf craft fin system of claim 1 wherein the fin plug interior has a front ramp and a rear ramp.

9. The surf craft fin system of claim 1 wherein the fin plug interior has a front undercut and a rear undercut.

* * * * *